US006074257A

United States Patent [19]

Fasano

[11] Patent Number: 6,074,257

[45] Date of Patent: Jun. 13, 2000

[54] ELECTRICAL CONNECTION STRIP WITH PIVOTING CONDUCTOR GUIDE

[75] Inventor: Michael Fasano, Huntington, N.Y.

[73] Assignee: Porta Systems Corp., Syosset, N.Y.

[21] Appl. No.: 09/167,648

[22] Filed: Oct. 6, 1998

[51] Int. Cl.[7] ..... H01R 9/22

[52] U.S. Cl. ..... 439/713; 439/404

[58] Field of Search ..... 439/709, 713, 439/719, 404, 405, 942

[56] References Cited

U.S. PATENT DOCUMENTS

| | | | |
|---|---|---|---|
| 3,798,587 | 3/1974 | Ellis, Jr. et al. . | |
| 4,066,316 | 1/1978 | Rollings . | |
| 4,099,823 | 7/1978 | D'Alessio | 439/713 |
| 4,175,818 | 11/1979 | Kourimsky et al. . | |
| 4,741,711 | 5/1988 | Singer, Jr. . | |
| 5,044,979 | 9/1991 | Siemon et al. . | |
| 5,086,368 | 2/1992 | Gerke et al. . | |
| 5,114,356 | 5/1992 | Taybl et al. . | |
| 5,160,273 | 11/1992 | Carney . | |
| 5,297,970 | 3/1994 | Carney . | |
| 5,342,209 | 8/1994 | Carney et al. . | |
| 5,356,309 | 10/1994 | Carney et al. . | |
| 5,494,461 | 2/1996 | Bippus et al. . | |
| 5,549,489 | 8/1996 | Baggett et al. . | |
| 5,575,689 | 11/1996 | Baggett et al. . | |
| 5,622,516 | 4/1997 | Baggett et al. . | |
| 5,647,760 | 7/1997 | Drach et al. . | |
| 5,722,850 | 3/1998 | White . | |

*Primary Examiner*—Michael L. Gallner
*Assistant Examiner*—Antoine Ngandjui
*Attorney, Agent, or Firm*—Hoffmann & Baron, LLP

[57] ABSTRACT

An electrical connection strip used for high density wiring in telecommunication systems includes an elongated block, a first and second row of connector elements and a conductor guide pivotally mounted to a bottom surface of the block. The connector elements are mounted within the block so that end portions of the first row of connector elements protrude through a top surface of the block and end portions of the second row of connector elements protrude through a bottom surface of the block. The conductor guide pivots to bend conductor wires connected to the second row of connector elements at the bottom surface of the block from a first position, in which the conductor wires are substantially parallel to the bottom surface, to a second position, in which the conductor wires are substantially perpendicular to the bottom surface.

8 Claims, 7 Drawing Sheets

ELECTRICAL CONNECTION STRIP WITH PIVOTING CONDUCTOR GUIDE

BACKGROUND OF THE INVENTION

1. Field of the Invention

The present invention relates to connection strips used for high density wiring in telecommunication systems, and more particularly relates to a novel electrical connection strip with a pivoting conductor guide which provides for easy installation and removal of closely spaced connection strips.

2. Description of the Prior Art

Connection strips for high density wiring in telecommunication systems are well known devices. One such device is described in U.S. Pat. No. 5,160,273 to William V. Carney, issued Nov. 3, 1992, and depicted in FIG. 1. The Carney '273 patent discloses a connector block assembly 100 containing pairs of spring finger connectors 101 arranged in parallel rows on a top surface 102 of the block assembly. Each contact includes an insulation piercing slot to receive a wire. One set of wires 103 is inserted into the piercing slots from one side of the block while a second set of wires 104 is inserted from the opposite side of the block. Thus, all wiring is generally done on the top surface of the connector block. (See FIG. 1.)

U.S. Pat. No. 5,575,689 to Baggett et al. discloses a similar connector module but has insulation piercing contacts disposed on an upper and lower surface of the connector, as shown in FIG. 2. This arrangement allows for wire insertion at a top surface 105 and a bottom surface 106 of the connector thereby reducing the number of wire terminations at the top surface. However, the wires still enter the block from the sides. (See FIG. 2.)

Referring back to FIG. 1, such connecting blocks are typically installed in a mounting bracket 107 in a side-by-side arrangement in close proximity to one another. Wires from the contacts are generally bunched along the sides of the blocks and are led to exit ports at a back surface of the mounting bracket (not shown). The wires disposed on the sides of such connector blocks may interfere with wires of other connector blocks when installing or removing the blocks. Accordingly, there is a need for an electrical connector block that alleviates the crowding of wires along the sides of the block thereby improving the ease with which such blocks may be installed and removed from mounting brackets.

OBJECTS AND SUMMARY OF THE INVENTION

It is an object of the present invention to provide an electrical connection strip used for high density wiring in telecommunication systems which substantially reduces the crowding of conductor wires along its sides.

It is another object of the present invention to provide an electrical connection strip which is capable of receiving wires at a top surface and a bottom surface wherein the wires terminating at the bottom surface are guided in a direction perpendicular to the bottom surface between the sides of the connection strip.

In accordance with one form of the present invention, an electrical connection strip includes an elongated block of electrically non-conductive material, a first and second row of connector elements and a conductor guide pivotally mounted to a bottom surface of the elongated block. The connector elements each have an end portion which provides electrical connection to a corresponding conductor. The first and second row of connector elements are mounted within the block such that the end portions of the first row extend through a top surface of the block and the end portions of the second row extend through the bottom surface of the block. The conductor guide mounted to the bottom surface of the block pivots from a first position, in which the conductors connected to the second row of connector elements are held substantially parallel to the bottom surface, to a second position, in which the conductors are bent substantially perpendicularly to the bottom surface. With this arrangement, one set of conductor wires is disposed along one side of the connection strip while the second set of wires extends away from the block perpendicularly to the bottom surface between the sides of the connection strip. This results in a connection strip having one side free of conducting wires.

In a preferred embodiment, the conductor guide is provided with grooves adjacent to and in alignment with corresponding connector elements for receiving and holding the wires during and after bending. Also, the end portion of each connector element preferably includes insulation piercing sidewalls which are capable of providing electrical connection to a corresponding conductor. The connector element also preferably includes a stem portion which makes electrical connection with corresponding stem portions of connector elements of the opposite row. These stem portions are accessible through slots defined in the top surface of the block. The preferred embodiment also includes insulation caps, disposed over the end portions of the first and second rows of connector elements, which include slits aligned with the corresponding end portions to permit conductors to be inserted therein for making electrical connection with the end portions.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
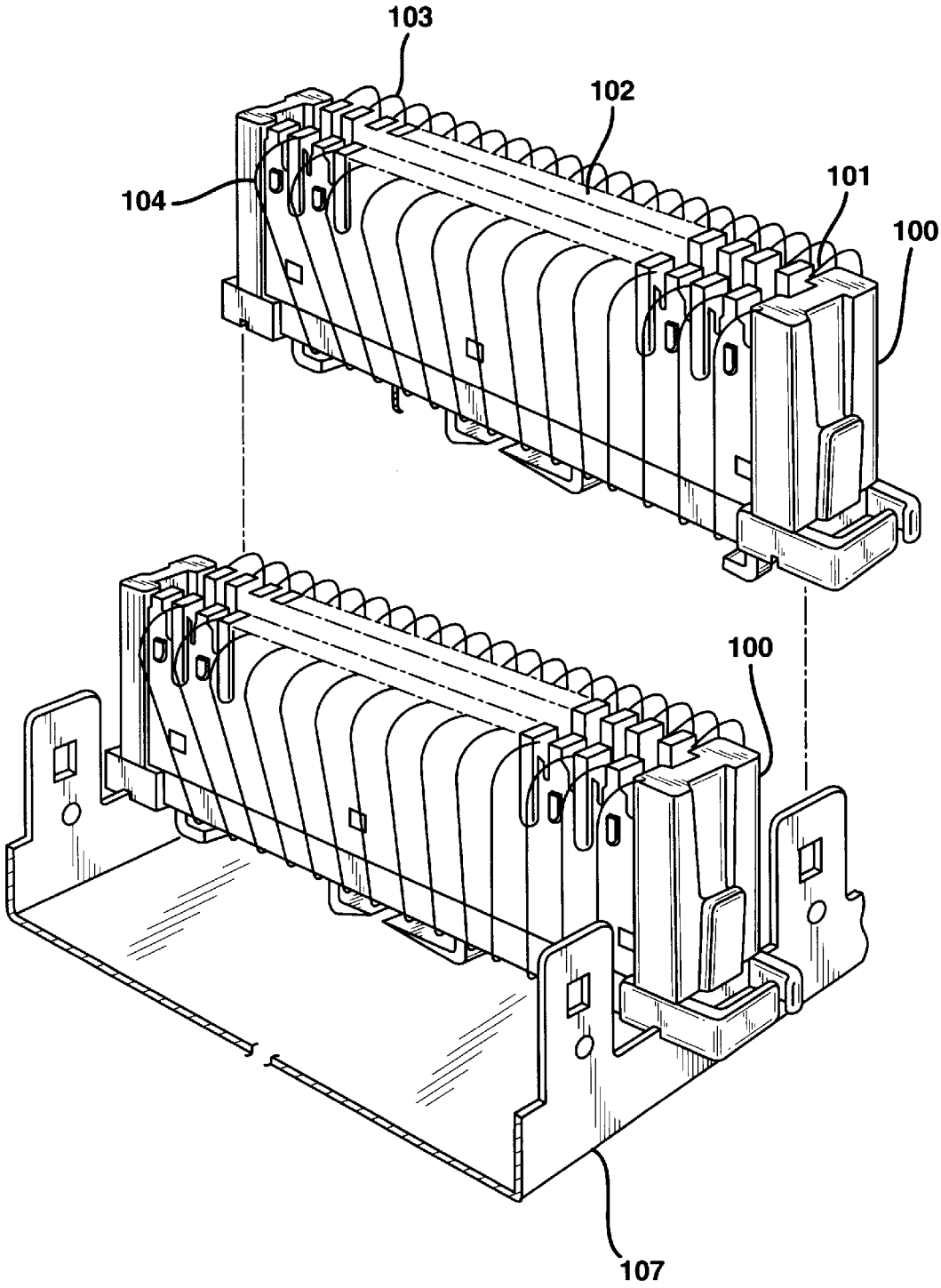
FIG. 1 PRIOR ART
FIG. 1 is a perspective view of a pair of prior art connection strips being installed on a mounting bracket.
Figure 2:
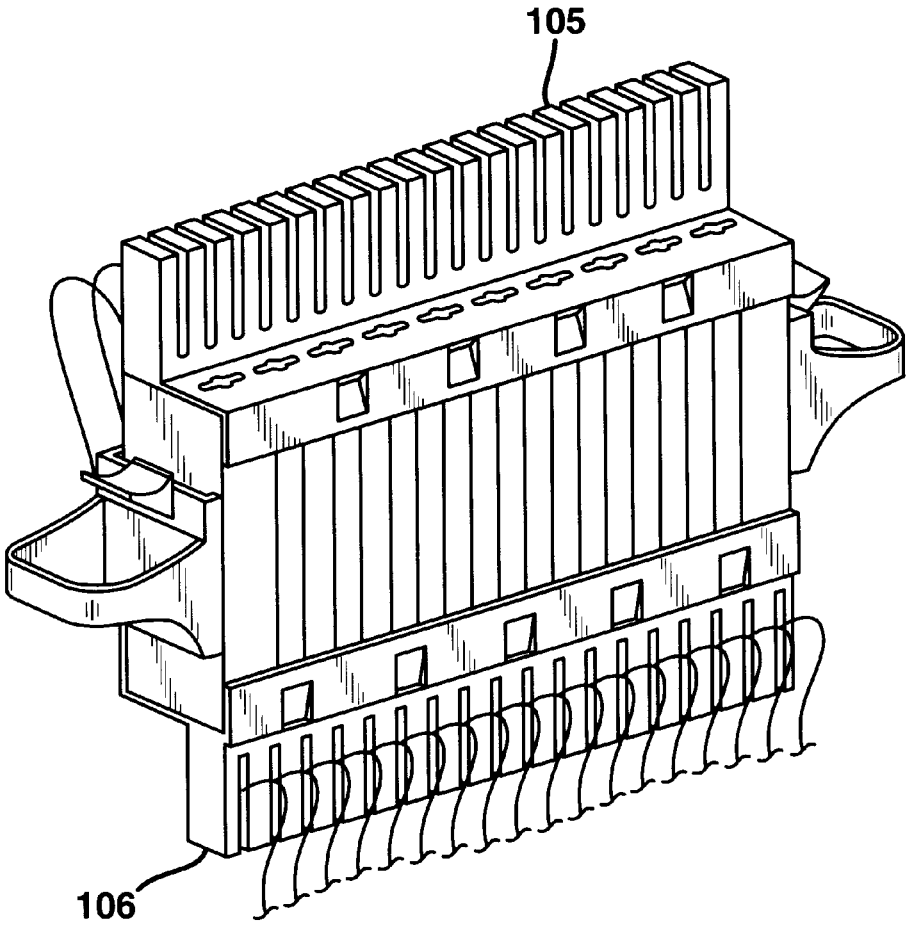
FIG. 2 PRIOR ART
FIG. 2 is a perspective view of another prior art connection strip having electrical contact elements on a top and bottom surface.
Figure 3:
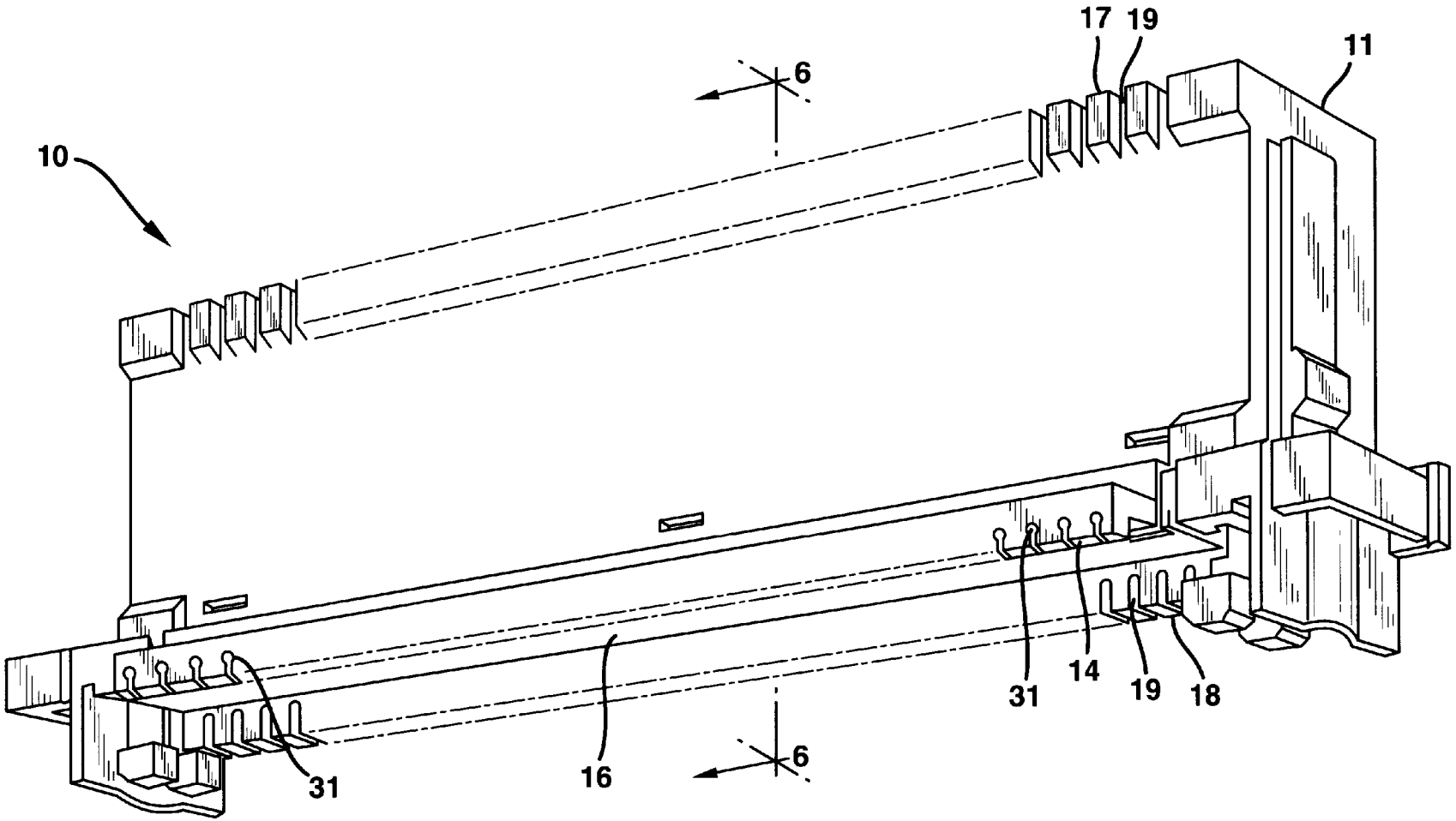
FIG. 3 is a perspective view of an electrical connection strip according to the present invention.

Referring now to FIGS. 3–8, an electrical connection strip 10, formed in accordance with the present invention is shown. Electrical connection strip 10 generally includes an elongated block 11, a first and second row of connector elements 12 and 13, respectively, and a conductor guide 14.

Elongated block 11 is preferably made of an electrically non-conducting material and is generally rectangular in shape having a top surface 15 and a bottom surface 16. Disposed on the top and bottom surfaces are insulating caps 17 and 18, respectively. Insulating caps 17 and 18 are preferably integrally formed with elongated block 11 as one piece and made of the same material. Each cap includes a series of spaced apart slits 19 formed partially therein which permit insertion of a wire therein as discussed below. The top surface 15 of elongated block 11 also includes a series of slots 20 (FIG. 6) which permit insertion of electrical test leads or wiring into the elongated block.

Figure 6:
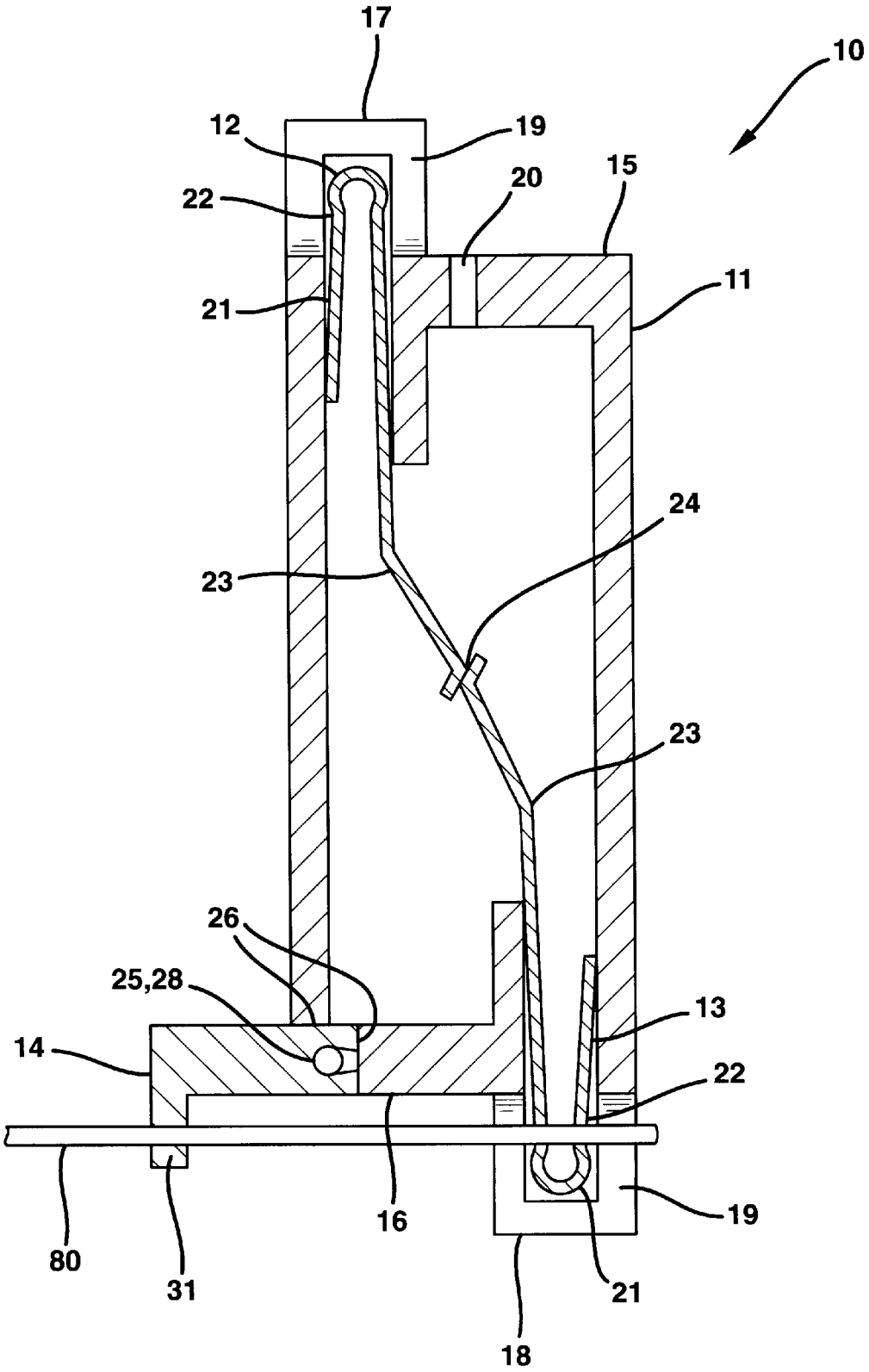
FIG. 6 is a cross-sectional view of the electrical connection strip according to the present invention and shown in FIG. 3, taken along line 6—6 of FIG. 3, with the conductor guide in its first position.
Figure 7:
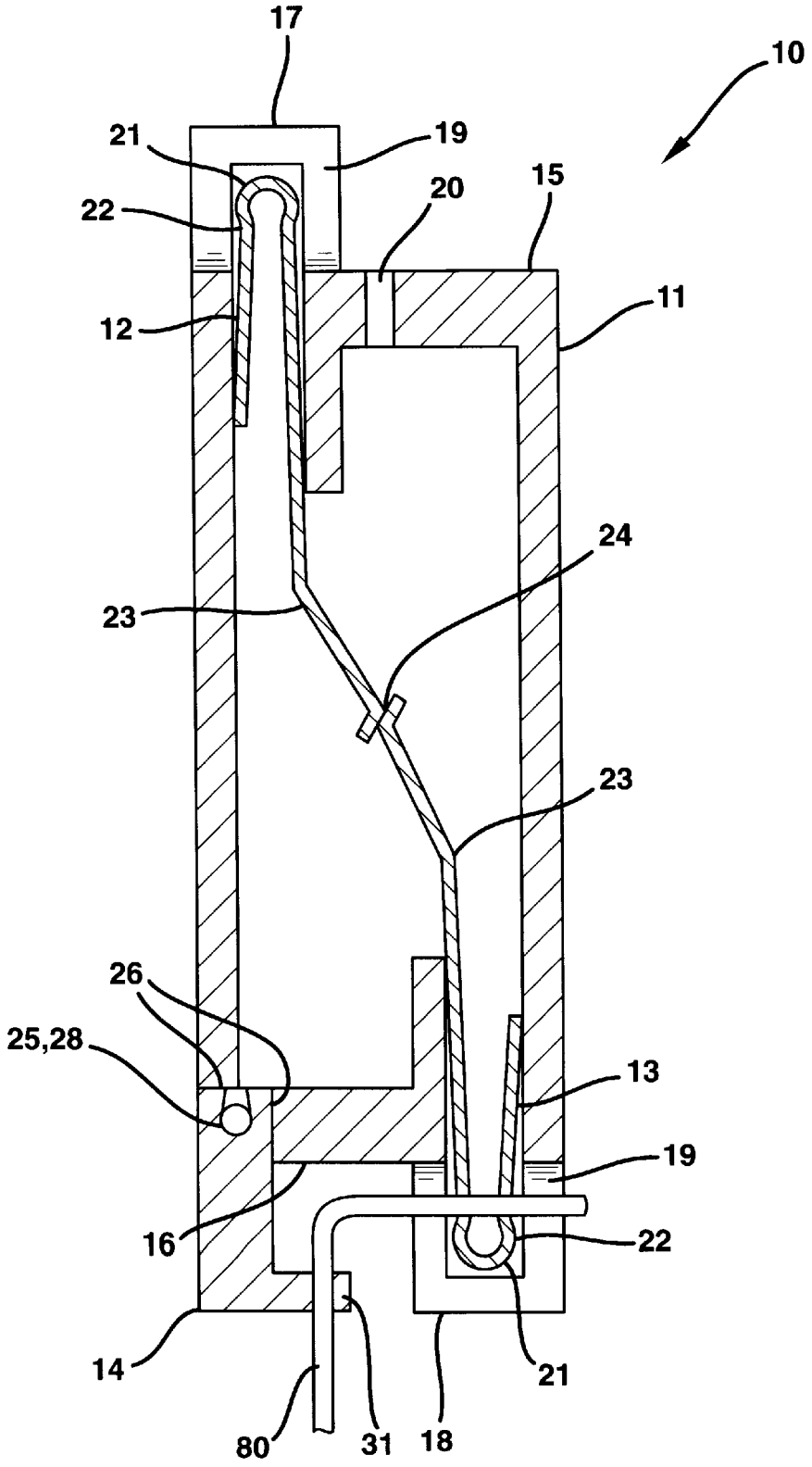
FIG. 7 is a cross-sectional view of the electrical connection strip according to the present invention and shown in FIG. 3, taken along line 6—6 of FIG. 3, but with the conductor guide shown in its second position.
Figure 8:
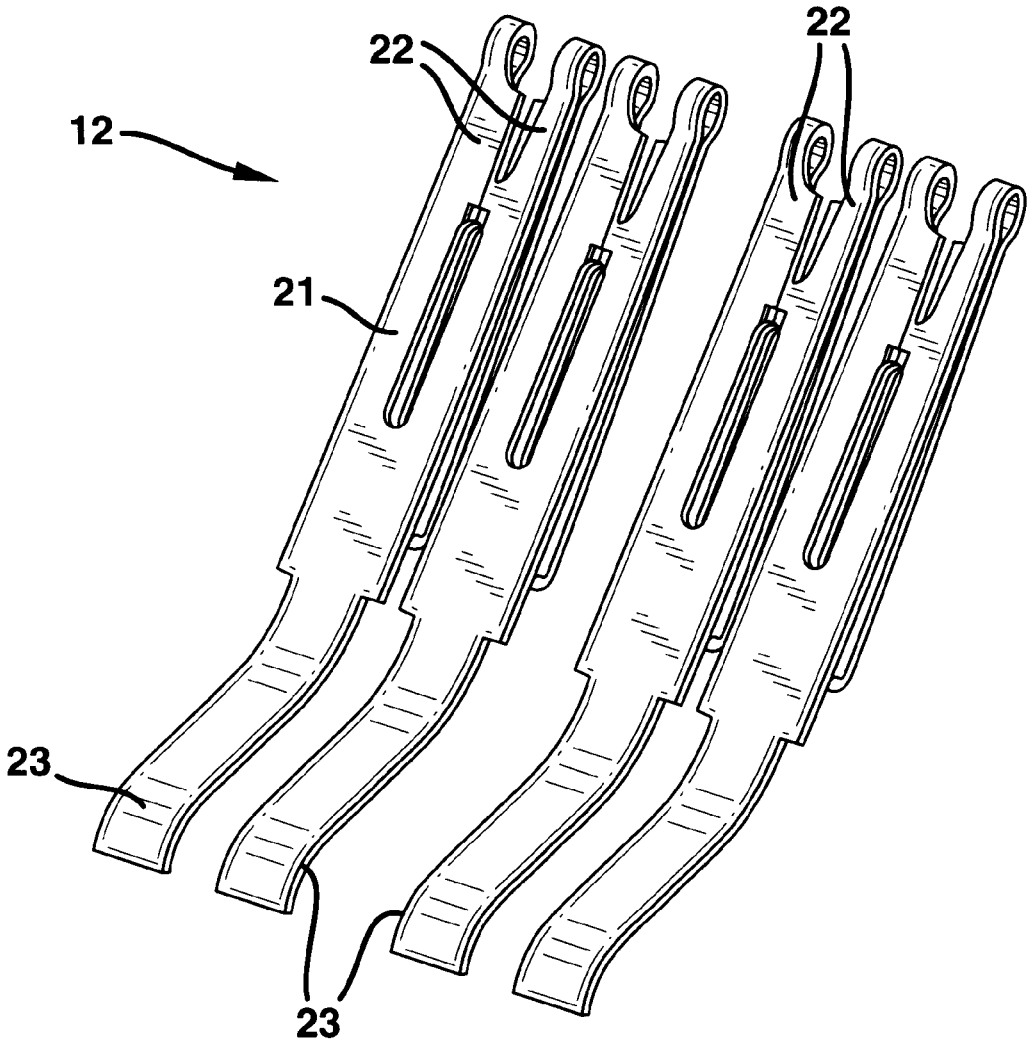
FIG. 8 is a perspective view of a row of connector elements of the electrical connection strip according to the present invention.

As shown in FIGS. 6, 7 and 8, mounted within the elongated block 11 is a first row of connector elements 12 and a second row of connector elements 13. Each connector element includes an end portion 21 which is capable of providing electrical connection to a wire. In a preferred embodiment, the end portion 21 includes oppositely disposed sharpened sidewalls 22 which pierce the insulation surrounding the wire to establish electrical contact. (See FIG. 8) The connector elements are mounted within the block 11 so that the end portions of the first row of connector elements 12 protrude through the top surface 15 of the block while the end portions of the second row of connector elements 13 protrude through the bottom surface 16 of the block. The end portions 21 are also aligned with corresponding slits 19 formed in the insulating caps 17 and 18 so that wires may be inserted through the caps for electrical connection with the connector elements.

The connector elements 12 and 13 are also provided with resilient stem portions 23 opposite the end portions 21. The stem portions 23 extend into the block 11 so that one connector element from the first row is biased against a corresponding connector element of the second row thereby making electrical contact at contact point 24. The contact points 24 are aligned with the slots 20 on the top surface 15 of the block 11 so that an electrical test lead (not shown) may be inserted in the slot to make contact with the stem portions of the connector elements.

Pivotally mounted to the bottom surface 16 of the block 11 is a conductor guide 14. (Alternatively, the conductor guide may be mounted to the top surface 15, in which case the test lead slots 20 would be located on the bottom surface 16.) Conductor guide 14 is preferably L-shaped in cross-section and has approximately the same longitudinal length as the block 11. Conductor guide 14 is also preferably made from the same electrically non-conducting material as the block 11 and is formed with a plurality of conductor retaining grooves 31. As shown in FIG. 5*a*, conductor retaining grooves 31 are generally channels defined by parallel side walls 32, separated by a distance slightly less than the diameter of the conductor, leading to a closed bulbous end 33 in which the conductor is loosely retained after it is inserted through the channel. When the conductor guide 14 is mounted to the bottom surface 16 of the block 11, these grooves 31 are aligned with corresponding slits 19 of the bottom insulating cap 18 and corresponding end portions 21 of the second row of connector elements 13. As discussed further below, the grooves retain the conductor wires during insertion and bending.

Figure 4A:
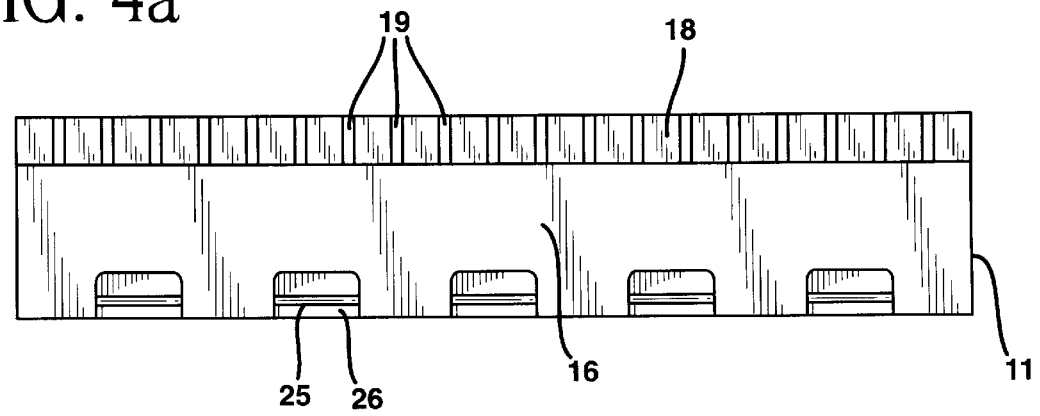
FIGS. 4*a* and 4*b* are plan views of alternate embodiments of the bottom surface of the electrical connection strip according to the present invention.
Figure 4B:
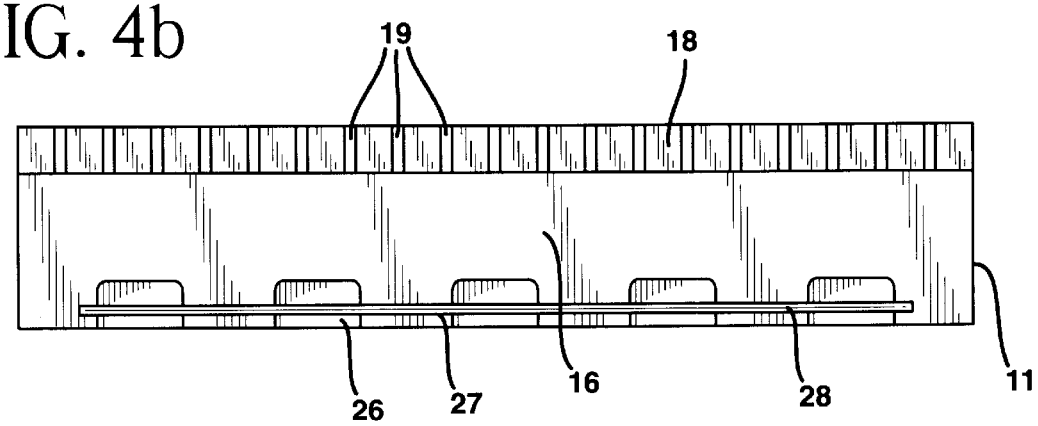
Figure 5:
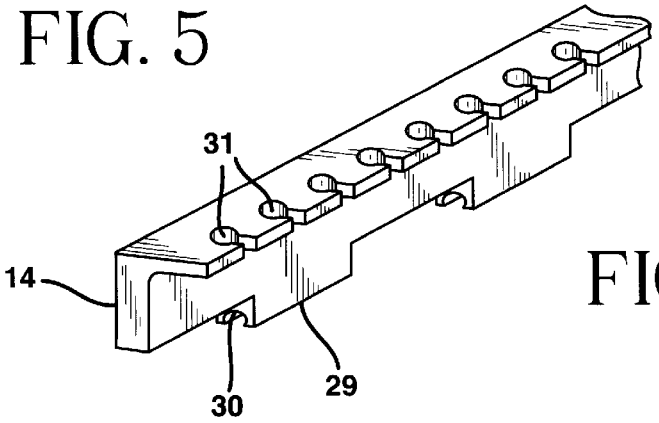
FIG. 5 is a perspective view of the conductor guide of the electrical connection strip according to the present invention.
Figure 5A:
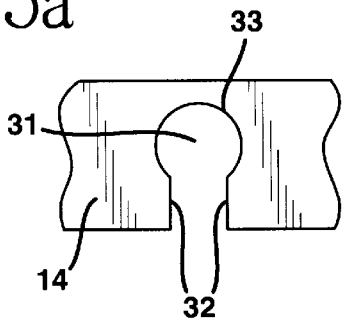
FIG. 5*a* is a detail plan view of one of the conductor retaining grooves shown in FIGS. 3 and 5.

Referring to FIGS. 4*a*, 4*b* and 5, alternate methods of mounting conductor guide 14 to the bottom surface 16 are shown. Referring first to FIG. 4*a*, in a preferred embodiment, a plurality of recesses 26 are formed within the bottom surface 16 of the block 11 and within each recess is disposed a rod 25. In an alternate embodiment, (FIG. 4*b*), the bottom surface 16 may be provided with a plurality of recesses 26 and a pin slot 27 in which a single pin 28 is frictionally held. The pin 28 is roughly the same length as block 11 and extends across the recesses 26, as shown in FIG. 4*b*. In both embodiments, the recesses 26 are generally rectangular in shape and receive corresponding hinge elements 29 formed on the conductor guide 14. (See also FIGS. 6 and 7) Each hinge element 29 is formed with a notch 30 which engages a corresponding rod 25, of the preferred embodiment, or the pin 28 of the alternate embodiment. The hinge elements 29 are force fitted onto the rods 25 or pin 28 in their respective notches 30 so that the conductor guide 14 remains mounted to the bottom surface 16 of the block 11 but may pivot about the rods or pin. The rectangular shape of the recesses 26 allow for limited 90° rotation of the conductor guide 14 from a first position, in which the conductor retaining grooves 31 are substantially collinear with the slits 19 of the bottom insulating cap 18, to a second position in which the conductor retaining grooves 31 are substantially perpendicular to the slits 19.

In use of electrical connection strip 10, conductor wires are inserted in the first row of connector elements 12 at the top surface 15 of the block 11 in the conventional manner and are generally disposed along one side of the block. However, insertion of conductor wires in the second row of connector elements 13 at the bottom surface 16 of the block is aided by the use of the conductor guide 14. Referring now to FIGS. 6 and 7, with the conductor guide 14 in its first position, the free end of a conductor wire 80 can be initially aligned with one of the connector elements of the second row 13 by placing the wire in the corresponding conductor retaining groove 31 of the conductor guide 14. The free end of the wire is then manually inserted between the insulation piercing sidewalls 22 of the connector element to make electrical connection to the connector element. This step is repeated for all of the conductor wires which are to be installed in the connection strip. Once all the conductor wires are inserted in their respective connector elements, the conductor guide 14 is manually pivoted to its second position, as shown in FIG. 7, thereby bending the conductor wires at generally a right angle (with an acceptable bend radius). The conductor wires are now generally perpendicular to the bottom surface 16 and are positioned between the sides of the block 11.

Thus, in accordance with the present invention, one side of the electrical connection strip 10 is free from conductor wires. In typical mounting brackets where a number of electrical connection strips are to be mounted side-by-side in close proximity, this feature greatly enhances the ease with which the connection strip may be installed and/or removed.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connection strip for providing a plurality of closely spaced connections to mutually adjacent electrical conductors, said electrical connection strip comprising:

a) an elongated block of electrically non-conductive material, said block having a first surface and a second surface;

b) a first and second row of connector elements mounted within said block, each connector element including an end portion, said end portion providing electrical connection to a conductor, said connector elements being mounted so that the end portions of the first row extend through said first surface and the end portions of the second row extend through said second surface; and c) a conductor guide mounted to one of said first or second surfaces for receiving at least one of said conductors, said conductor guide being pivotable with respect to said connector elements between a first position, in which the conductors are held substantially parallel to said first or second surface, to a second position in which the conductors are bent substantially perpendicular to said first or second surface.

2. An electrical connection strip as defined in claim 1, wherein the conductor guide is formed with grooves adjacent to corresponding end portions of the second row of connector elements, said grooves receiving and holding the conductors during and after bending.

3. An electrical connection strip as defined in claim 1, wherein each of the end portions includes oppositely disposed sharpened sidewalls defining an insulation piercing slot, said sidewalls providing electrical connection to a conductor.

4. An electrical connection strip as defined in claim 1, wherein each connector element further comprises a stem portion, said stem portions of the first row of connector elements making electrical connection with said stem portions of the second row of connector elements.

5. An electrical connection strip as defined in claim 1, wherein the block further comprises insulating caps disposed over the end portions of the first and second rows of connector elements, said caps defining slits aligned with corresponding end portions to permit conductors to be inserted therein for making electrical connection with the end portions.

6. An electrical connection strip as defined in claim 1, wherein one of the first or second surfaces defines at least one recess having a rod disposed therein, and wherein the conductor guide includes at least one hinge element cooperating with said recess, said hinge element defining a notch for receiving said rod.

7. An electrical connection strip as defined in claim 6, wherein the at least one recess is rectangular in shape and cooperates with the hinge element to permit limited 90° pivotal movement of the conductor guide.

8. An electrical connection strip as defined in claim 7, wherein one of said first or second surfaces defines at least one slot for receiving a lead therein which makes electrical contact with the stem portions of the connector elements.

* * * * *